US006702373B2

(12) United States Patent
Rossko

(10) Patent No.: US 6,702,373 B2
(45) Date of Patent: Mar. 9, 2004

(54) SYSTEM PROVIDING A PLURALITY OF ADJUSTABLE PLATFORMS ON A CHAIR

(76) Inventor: Dennis D. Rossko, 2163 Cordoba Dr., Carrollton, TX (US) 75006

( * ) Notice: Subject to any disclaimer, the term of this patent is extended or adjusted under 35 U.S.C. 154(b) by 0 days.

(21) Appl. No.: 10/059,756

(22) Filed: Jan. 29, 2002

(65) Prior Publication Data

US 2003/0141750 A1 Jul. 31, 2003

(51) Int. Cl.[7] ..... A47C 9/04

(52) U.S. Cl. ..... 297/173; 297/411.36; 297/188.14; 297/170

(58) Field of Search ..... 297/188.01, 188.14, 297/188.21, 188.18, 188.2, 217.3, 173, 174

(56) References Cited

U.S. PATENT DOCUMENTS

| | | | | | |
|---|---|---|---|---|---|
| 4,436,339 | A | * | 3/1984 | Albers | 297/153 |
| 5,022,706 | A | | 6/1991 | Bryan | 297/162 |
| 5,588,697 | A | * | 12/1996 | Yoshida et al. | 297/173 |
| 5,653,499 | A | * | 8/1997 | Goodall | 297/170 |
| 5,779,305 | A | * | 7/1998 | Hocking | 297/217.4 |
| 5,893,607 | A | * | 4/1999 | Trimnell | 297/170 |
| 6,045,179 | A | * | 4/2000 | Harrison | 297/188.2 |
| 6,059,357 | A | * | 5/2000 | Peart | 297/173 |
| 6,092,867 | A | | 7/2000 | Miller | 297/188.14 |
| 6,092,868 | A | | 7/2000 | Wynn | 297/217.3 |
| 6,102,476 | A | | 8/2000 | May et al. | 297/217.3 |
| 6,123,387 | A | | 9/2000 | Kelly | 297/188.18 |
| 6,145,926 | A | | 11/2000 | Lin | 297/217.3 |
| 6,206,464 | B1 | | 3/2001 | Santa Rosa et al. | 297/173 |
| 6,237,997 | B1 | | 5/2001 | Olson | 297/162 |
| 6,264,272 | B1 | | 7/2001 | Jones et al. | 297/173 |
| 6,341,821 | B1 | * | 1/2002 | Rousseau | 297/411.36 |
| 6,354,658 | B1 | * | 3/2002 | Sher et al. | 297/188.14 |
| 6,375,259 | B1 | * | 4/2002 | Ma | 297/217.3 |
| 6,425,631 | B1 | * | 7/2002 | Lin | 297/173 |

* cited by examiner

*Primary Examiner*—Peter M. Cuomo
*Assistant Examiner*—Stephanie Harris
(74) *Attorney, Agent, or Firm*—Michael L. Diaz

(57) ABSTRACT

A system having a plurality of platforms for positioning control devices near an occupant of a chair. The system includes a first and second support shaft affixed to each side of a chair. A first side platform is affixed to the first support shaft. A second side platform is affixed to the second support shaft. A front platform is positioned in front of the chair. The front platform may be rotated away from the front of the chair by a pivot system which assists in moving the front platform. The system may also include two accessory platforms mounted adjacent each side platform. All the platforms may be adjustably positioned for the occupant of the chair. Computer and gaming control devices may be placed on top of the platforms.

17 Claims, 8 Drawing Sheets

SYSTEM PROVIDING A PLURALITY OF ADJUSTABLE PLATFORMS ON A CHAIR

BACKGROUND OF THE INVENTION

1. Technical Field of the Invention

This invention relates to chairs, and more particularly, to a system having a plurality of adjustable platforms to accommodate electronic devices for use by a person seated on a chair.

2. Description of Related Art

The use of computers for business and entertainment has increased tremendously over the years. It is quite common for computers and their associated electronic accessories to be positioned upon a desk. For example, a computer operator places a chair near a desk holding a computer, computer monitor, and a keyboard. The operator must manipulate the appropriate controls utilizing the top of the desk as a platform for the computer controls, such as the mouse and keyboard. In addition, if the operator is playing a video game, other electronic peripheral devices are required, such as joysticks and throttle controls. Placement of the various control devices are limited by the size, height and angle of the computer desk. Thus, operating these devices over a period of time can become very uncomfortable. In fact, many repetitive actions required in operating the computer control devices by the operator have been known to cause pain and damage to the operator. In particular, use of gaming controls often requires nearly instantaneous responses by the operator, which puts stress on the operator's arms and hands. An apparatus is needed which allows an operator to comfortably manipulate a wide variety of control devices for a computer/gaming system.

Although there are no known prior art teachings of a solution to the aforementioned deficiency and shortcoming such as that disclosed herein, prior art references that discuss subject matter that bears some relation to matters discussed herein are U.S. Pat. No. 6,092,868 to Wynn (Wynn), U.S. Pat. No. 6,102,476 to May et al. (May), U.S. Pat. No. 6,123,387 to Kelly (Kelly), U.S. Pat. No. 6,206,464 to Santa Rosa et al. (Santa Rosa), and U.S. Pat. No. 6,237,997 to Olson (Olson).

Wynn discloses a computer work station having a reclining chair with a back rest, a seat, a leg rest and a pair of armrests. The reclining chair has a support base for supporting the reclining chair above the surface. A computer is mounted to the reclining chair. A pair of key pads electrically connected to the computer are provided upon each arm rests. The key pads are swivelably attached to the arm rests. A monitor is also pivotally connected to the back rest. Although Wynn discloses a chair having rotatably mounted key pads and a monitor, Wynn does not teach or suggest adding additional control devices to the chair. Additionally, Wynn suffers from the limitation that the keypads do not adjust in all axes.

May discloses furniture having an integrated computer. The furniture includes a chair with large cushions and a pair of wide armrests. Within the right armrest is a hollowed area for housing a computer. A small console at the front of the right armrest houses a removable media drive. A pad is located on the right arm rest. The pad may support a mouse, joystick or other input device. A monitor support and a keyboard support are mounted on a horizontal arm pivotally attached to the left arm rest. A pair of speakers are mounted on either side of a headrest. However, May does not teach or suggest a plurality of control devices simultaneously stowed on the chair. May merely discloses a chair having a platform allotted for one control item (e.g., mouse or joystick). In addition, May suffers from the disadvantage of requiring the specific manufacture of the chair, rather than incorporating the control devices into an existing chair.

Kelly discloses another chair having a first platform for supporting a computer keyboard and a second platform for support a computer mouse. Both platforms are connected to a preselected armrest of the chair. The first platform is pivotally mounted in a horizontal plane so that it can be swung out of position to enable a user to get out of the chair. The first platform is also tiltable about a horizontal axis to enable the user to adjust its orientation to a comfortable position. The second platform is mounted to a left armrest to comfortably position the mouse for left-handed users and to the right armrest for right-handed users. However, Kelly does not teach or suggest connecting any other control devices to the chair. Additionally, the keyboard and mouse are not capable of being adjusted in all three axes.

Santa Rosa discloses an adjustable platform support assembly for supporting a computer input device, such as a keyboard, mouse or similar device. Each support platform is directly attached to a length of flexible gooseneck shaft which is attached to a coupling assembly. The coupling assembly is designed to be secured to an arm or a chair. The assembly enables a computer operator to swivel and/or recline in the chair without having to readjust the platform position. Santa Rosa does not teach or suggest providing a plurality of platforms to accommodate additional devices besides a mouse and keyboard. In addition, Santa Rosa does not teach or suggest a rotatably mounted keyboard utilizing a tool balancer. Kelly also suffers the disadvantage of being flimsy and certainly unable to withstand heavy repetitive use.

Olson discloses a work station which includes a chair, at least one keyboard section, and at least one support assembly. The support assembly connects the chair to the keyboard section. The support assembly is also moveable between a first orientation and second orientation such that the keyboard section in the first orientation extends outward from the chair in a plane generally parallel to the floor and the keyboard section in the second orientation extends downward in a plane generally perpendicular to the floor. However, Olson does not teach or suggest positioning the keyboards in all three axes. In addition, Olson does not disclose providing additional control devices upon the chair. Olsen also does not teach or suggest connecting any other control devices to the chair.

Review of the foregoing references reveals no disclosure or suggestion of an apparatus or method as that described and claimed herein. Thus, it would be a distinct advantage to have an apparatus which may be attached to a chair and provides a plurality of three dimensionally adjustable platforms for various electronic devices. It is an object of the present invention to provide such an apparatus or method.

SUMMARY OF THE INVENTION

In one aspect, the present invention is a system for attaching a plurality of platforms to a chair. The system includes a first support shaft affixed to a first side of the chair and a second support shaft affixed to a second side of the chair. A first platform is attached to the first support shaft. A second platform is attached to the second support shaft. In addition, a front platform is positioned in front of the chair. The front platform is rotatably affixed to the first support shaft. The first, second and front platforms may be adjustably positioned in a plurality of axes and capable of accommodating at least one control input device each.

In another aspect, the present invention is a system for positioning control devices on a chair. The system includes a chair having a first side and an opposite second side, a first support shaft affixed to the first side of the chair, and a second support shaft affixed to the second side of the chair. A first platform is attached to the first support shaft and a second platform is attached to the second support shaft. A front platform is positioned in front of the chair. The front platform is also rotatably affixed to the first support shaft. The first, second and front platforms may be adjustably positioned in a plurality of axes and capable of accommodating at least one control input device each.

In still another aspect, the present invention is a system for positioning control devices on a chair. The system includes a chair having a first side and an opposite second side, a first support shaft detachably affixed to the first side of the chair, and a second support shaft detachably affixed to the second side of the chair. The system also includes a first platform attached to the first support shaft. The first platform has a first coupling device for adjusting a horizontal and lateral position of the first platform in relation to the chair. In addition, the system includes a second platform attached to the second support shaft. The second platform has a second coupling device for adjusting a horizontal and lateral position of the second platform in relation to the chair. A front platform is positioned in front of the chair and rotatably affixed to the first support shaft. The front platform has a third coupling device for adjusting a horizontal and lateral position of the front platform in relation to the chair and capable of being pivoted away from a front portion of the chair. The first, second and front platforms may be adjustably positioned in a plurality of axes and capable of accommodating at least one control input device.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
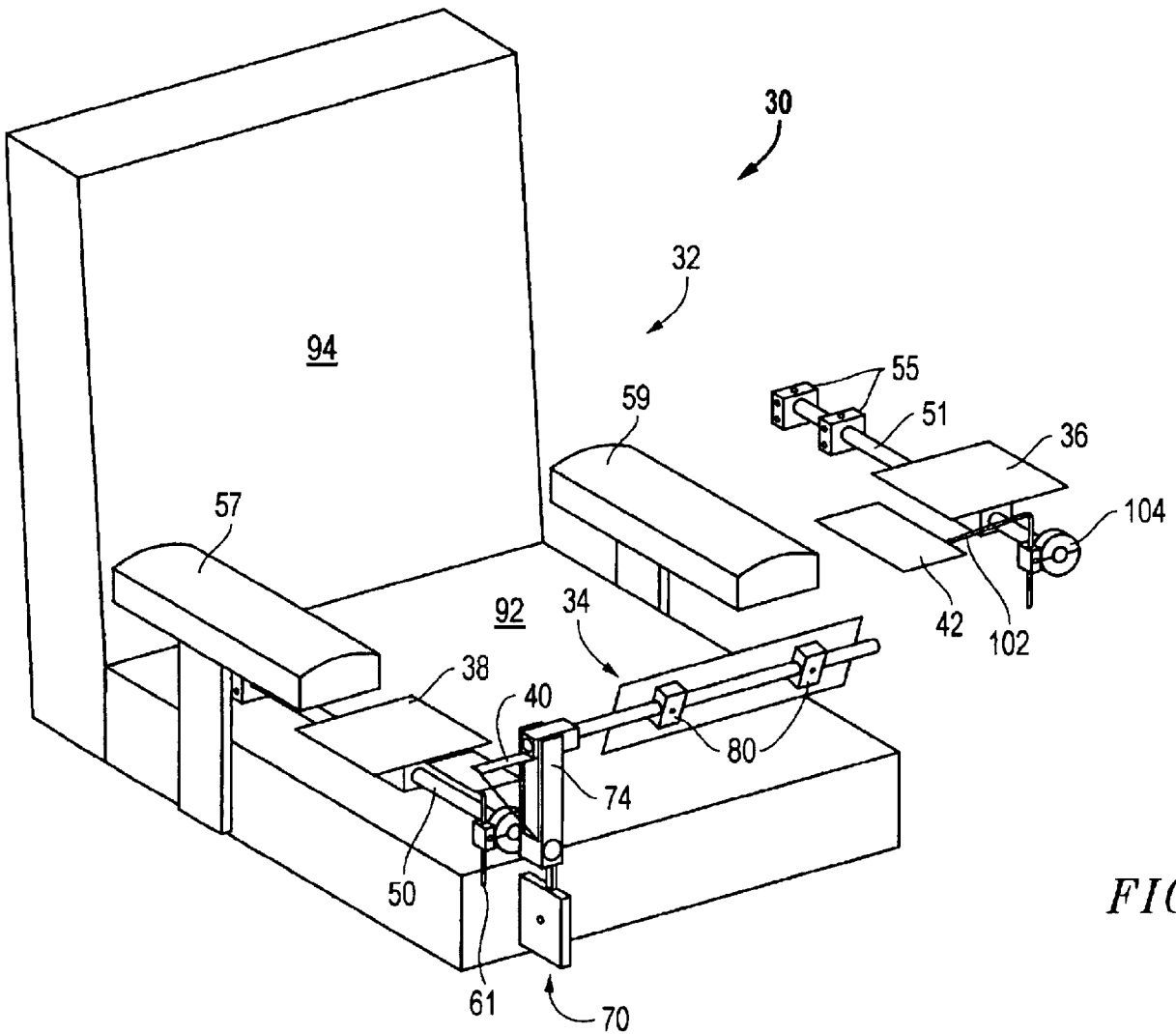
FIG. 1 is a front perspective view of a system in the preferred embodiment of the present invention.

A chair having a plurality of adjustable platforms for computer and gaming control devices is disclosed. FIG. 1 is a front perspective view of a system 30 in the preferred embodiment of the present invention. The system 30 includes a pivotable front platform 34, a left side auxiliary platform 36, a right side auxiliary platform 38, a primary side accessory platform 40, and a secondary side accessory platform 42. The system 30 is attached to a chair 32. The left side platforms are shown unattached for clarity.

Figure 2:
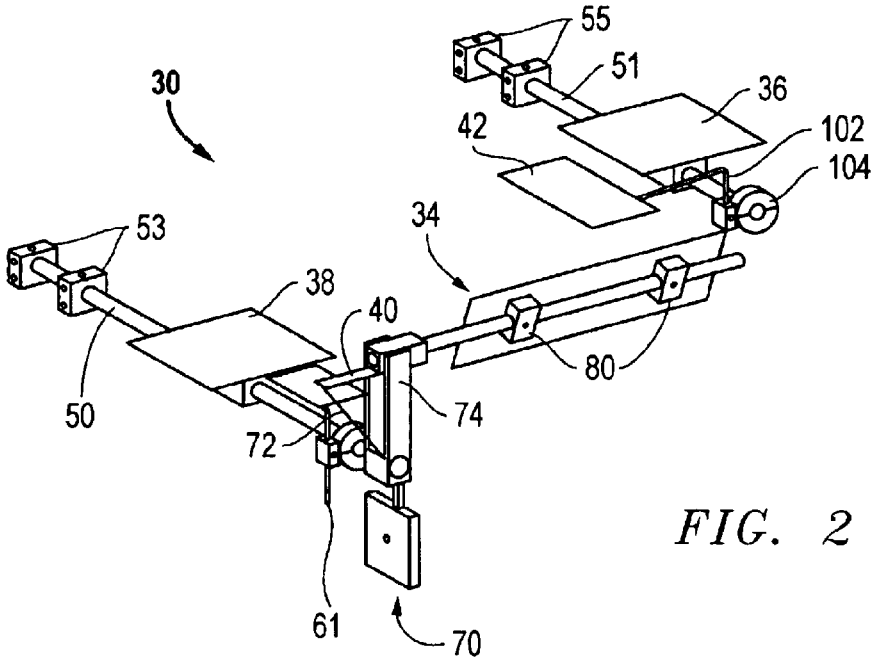
FIG. 2 is a front perspective view of the system of FIG. 1 without the chair.

FIG. 2 is a front perspective view of the system 30 of FIG. 1 without the chair 32. The plurality of platforms provide an area for positioning a plurality of gaming or computer control devices near a person occupying the chair 32. By placing all the control devices near an operator of the system 30, a desk or table is no longer required. The operator, through adjustable positioning of the mounted platforms, may comfortably operate a computer or gaming system.

The main interface for the plurality of plurality of platforms to the chair 32 are two master support shafts 50 and 51. The master support shafts are affixed, either permanently or temporarily to a portion of the chair. In the preferred embodiment of the present invention, right and left support blocks 53 and 55 are used as attachment devices for connecting the shafts to the chair. Each master support shaft runs through bores located in each block (not shown). The blocks are secured to each master support shaft by set screws. Conventional C-clamps (not shown) may also be affixed to the support blocks for allowing the support blocks to be clamped onto the chairs armrests 57 and 59 (See FIG. 1). Thus the overall positioning of the system 30 in relationship to the armrests and chair may be altered for each user by adjusting the support blocks forward and aft. It should be understood that any connecting device may be utilized to secure the master support shafts to the chair. In an alternate embodiment of the present invention, the plurality of platforms are mounted directly to the chair 32 without using the master support shafts.

Figure 3:
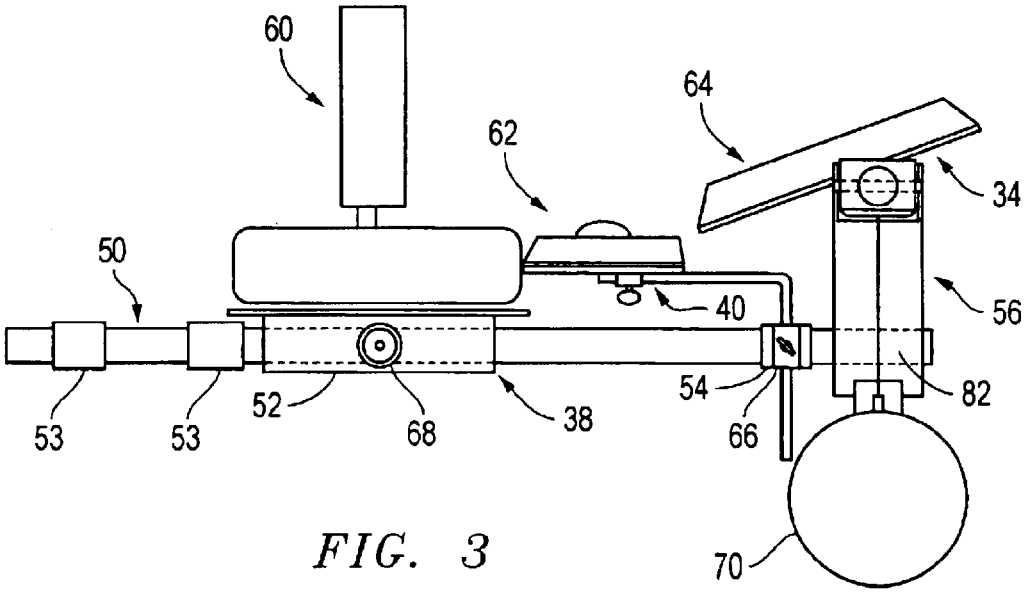
FIG. 3 is a partial right side view of the front platform, right side auxiliary platform, and the primary side accessory platform in the preferred embodiment of the present invention.

FIG. 3 is a partial right side view of the front platform 34, right side auxiliary platform 38, and the primary side accessory platform 40 in the preferred embodiment of the present invention. The right side auxiliary platform is affixed to the right master support shaft 50 by a locking slide 52 surrounding the master support shaft. The locking slide may be held in position by a conventional tension screw 68. The right side auxiliary platform may hold any control device. In the preferred embodiment of the present invention, the right side auxiliary platform includes a joystick 60.

The primary side accessory platform 40 is affixed to the right master support shaft 53 by a collar 54, which surrounds the master support shaft in a specified position. In an alternate embodiment of the present invention, the collar 54 may be a locking slide similar to the locking slide 52. The primary side accessory platform may also hold any device, however, a computer mouse device or computer trackball 62 is preferably positioned on this platform. The collar 54 may be tightened by a set screw 66. The collar 54 may be longitudinally adjusted along the length of the arm rest. A rod 61 (FIG. 2) may also be utilized for extending the platform from the collar. The rod allows vertical movement of the primary side accessory platform by extending the rod upwardly or downwardly through an attachment interface with the collar. In addition, the rod may swivel for lateral movement of the platform. The collar may also be rotated laterally. When the desired position of the platform is reached, the set screw is rotated to clamp the collar 54 against the master support shaft. The collar 54 and set screw allow movement of the primary side accessory platform in three dimensions for maximum flexibility in adjustment by the operator.

The front platform is pivotally mounted to the right arm rest by a pivot system 56. The front platform preferably includes a keyboard 64. However, the front platform may accommodate a laptop computer or any other control device or computer accessory (e.g., steering wheels, visual displays, etc.). The control devices may be affixed to the platforms in any fashion which provides secure attachment of the devices to the platform during actuation of the controls. In one embodiment, the control devices are attached to the platforms by use of hook and loop strips affixed to opposing contact surface. In another embodiment, a bottom surface of each control device may include a slot or groove while the platform may include a slide mount to accommodate the slot.

Figure 4:
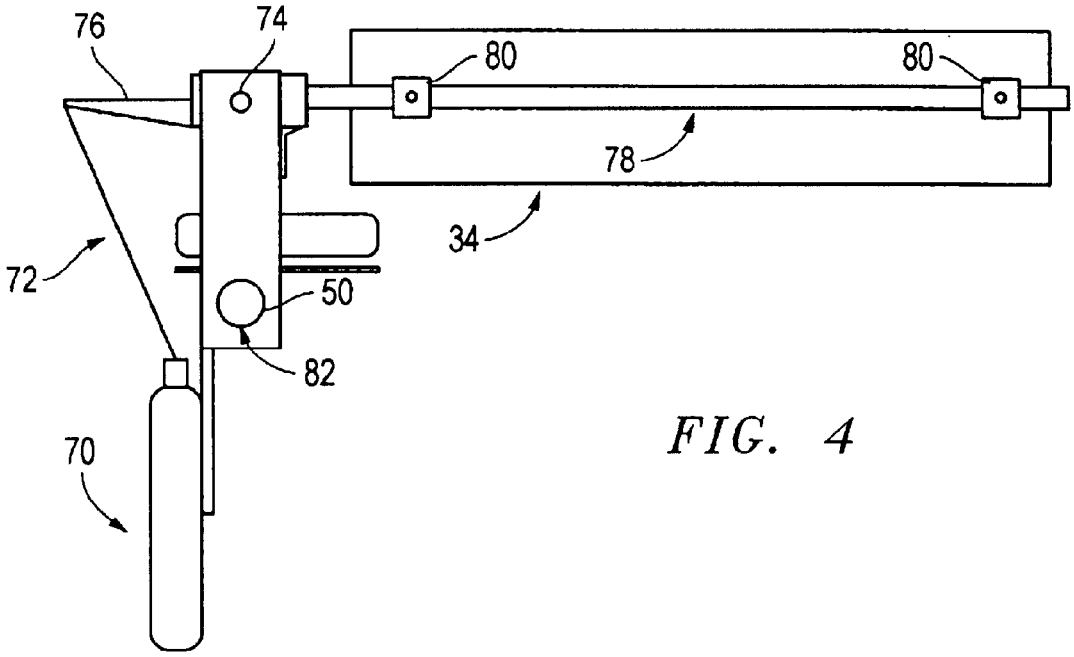
FIG. 4 is a partial front view of the front platform and pivot system in an extended position.

FIG. 4 is a partial front view of the front platform 34 and pivot system 56 in an extended position. The pivot system includes a tool balancer 70, a cable 72, a pivot point 74, a moment arm 76, and an extension arm 78. The primary side accessory platform 40 is removed for simplicity. In the preferred embodiment of the present invention, the front platform may be extended to a position in front of the operator seated in chair 32. The front platform is mounted to the extension arm 78 by a plurality of mounting blocks 80. The mounting blocks attach to the front platform 34 by encompassing the extension arm 78. Thumbscrews (not shown) allow adjustment of the front platform in two directions (horizontally and rotationally). The keyboard 64 may be optionally affixed to the platform directly by an adhesive glue, bolts, or hook and loop strips. Any connecting means may be utilized which securely affixes the keyboard (or other control device) to the front platform. The front platform may be optionally rotated to a pitch angle desired by the operator. The pivot system is mounted to the right master support shaft 50 by providing an opening 82 through which the support shaft runs through.

The tool balancer 70 is preferably a conventional and adjustable counter balance common in many household items. The tool balancer provides an adjustment to counteract a weight positioned upon the front platform 34. The tool balancer provides a counterweight to a wide range of weights positioned upon the front platform. The tool balancer may also be purchased with a counterweight of a specific weight or include the capability of adjusting the amount or position of the counterweight.

Figure 5:
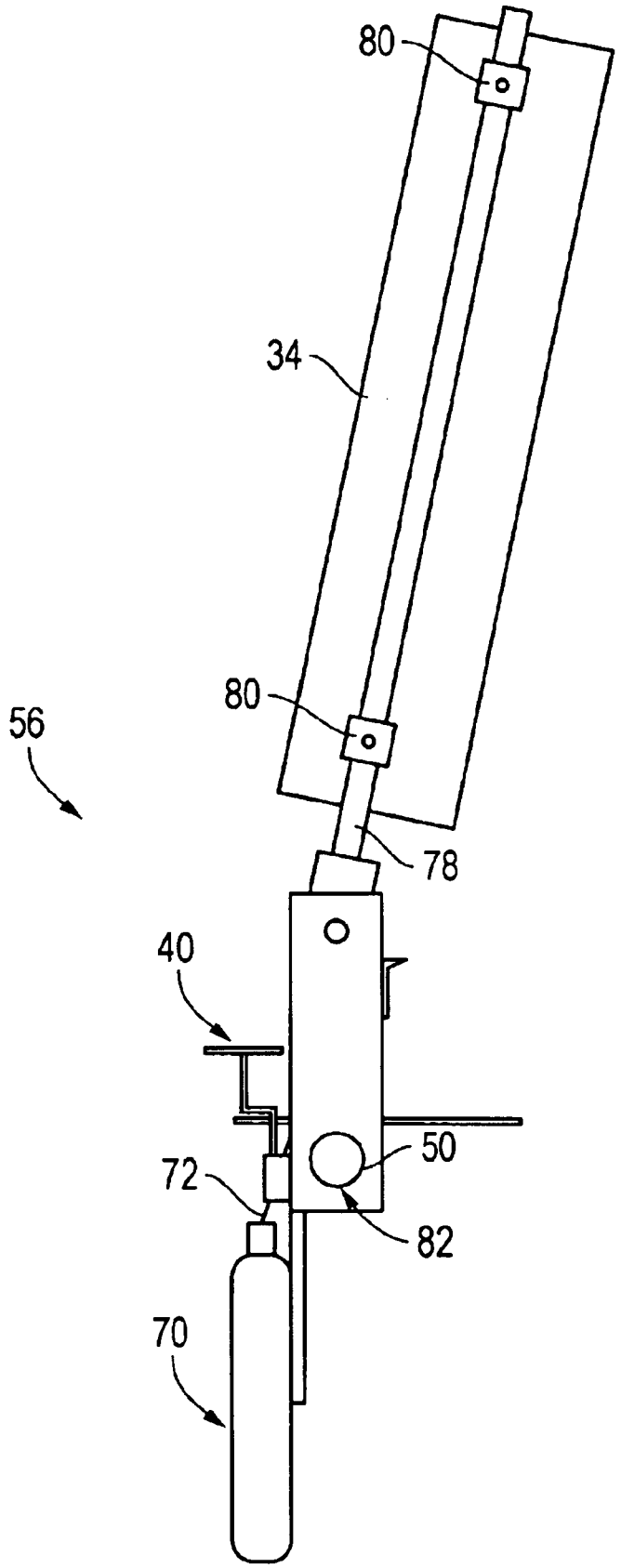
FIG. 5 is a partial front view of the front platform and pivot system in a raised position.

FIG. 5 is a partial front view of the front platform 34 and pivot system 56 in a raised position. When the operator is leaving or sitting down on the chair 32, the front platform is raised to the raised position.

Referring to FIGS. 4 and 5, the operation of the forward platform 34 will now be explained. The forward platform is normally extended to the extended position (FIG. 4). When it is desired by the operator to raise the forward platform, the forward platform and extension arm 78 are rotated upwardly. The tool balancer enables the forward platform to be raised with ease ("near zero effort movement") by the operator. In addition, the forward platform may then be held in the raised position until downward force is applied. The forward platform may be optionally held in the raised or extended position by a safety latch (not shown). The tool balancer assists in the upward movement of the forward platform by pulling the cable 72 downwardly toward the tool balancer. The cable pulls the moment arm which, in turn, pulls the extension arm upwardly about the pivot point 74.

When it is desired to position the forward platform in the extended position, downward force is applied on the forward platform. The counter balance slowly releases the cable, thus allowing the moment arm 78 to move upwardly and the extension arm 78 to rotate downwardly about the pivot 74. The tool balancer prevents the forward platform from slamming down into the extended position.

Although the forward platform is illustrated on the right arm rest, it should be understood that the forward platform may be affixed to the left arm rest. In addition, the pivot system is the preferred embodiment of enabling the forward platform to be positioned away from the chair 32. In an alternate embodiment of the present invention, the forward platform is assisted by a pneumatic system forcing the platform to the extended or raised position. In addition, the forward platform may not include the pivot system.

Figure 6:
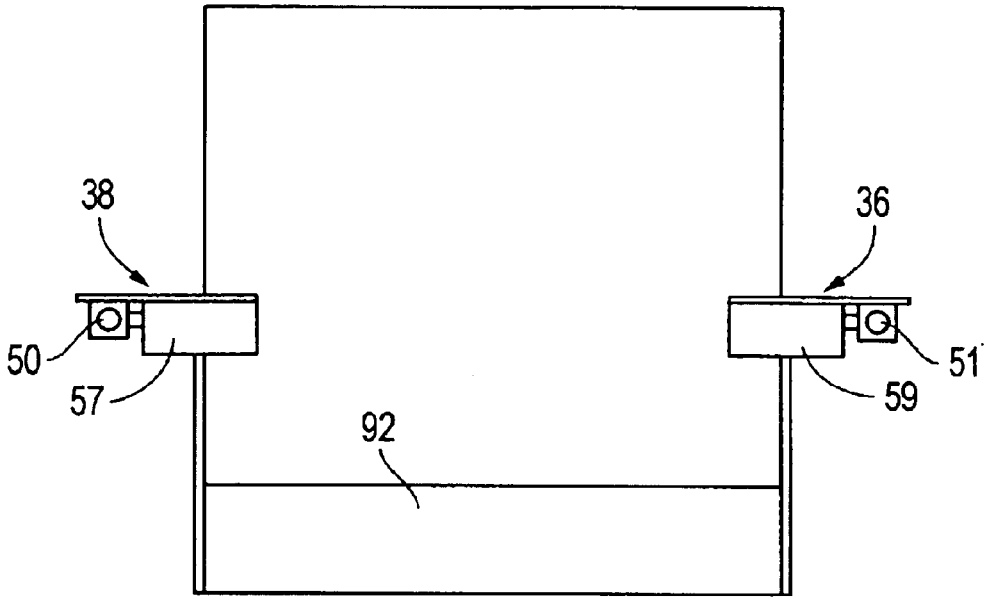
FIG. 6 is a partial front view of the left and right side auxiliary platforms in the extended position.
Figure 7:
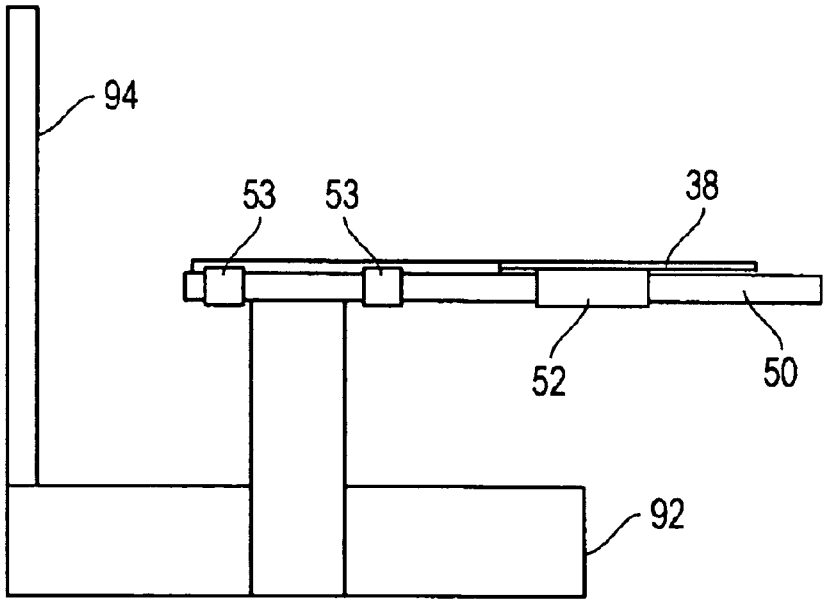
FIG. 7 is a right side view of the right auxiliary platform of FIG. 5.

FIG. 6 is a partial front view of the left and right side auxiliary platforms 36 and 38 in the extended position. FIG. 7 is a right side view of the right auxiliary platform 38 of FIG. 5. The right auxiliary platform 38 is affixed to the master support shaft 50. The left auxiliary platform 36 is affixed to left master support shaft 51. As illustrated, the chair 32 includes the arm rests 57 and 59, a bottom cushion 92, and a back cushion 94.

Figure 8:
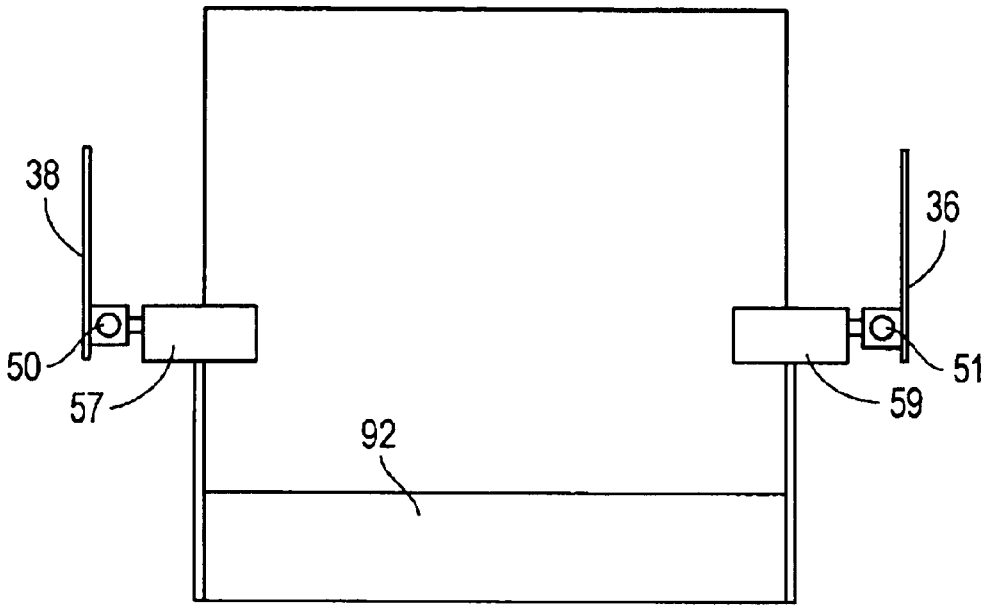
FIG. 8 is a partial front view of the left and right side auxiliary platforms in a stowed position.
Figure 9:
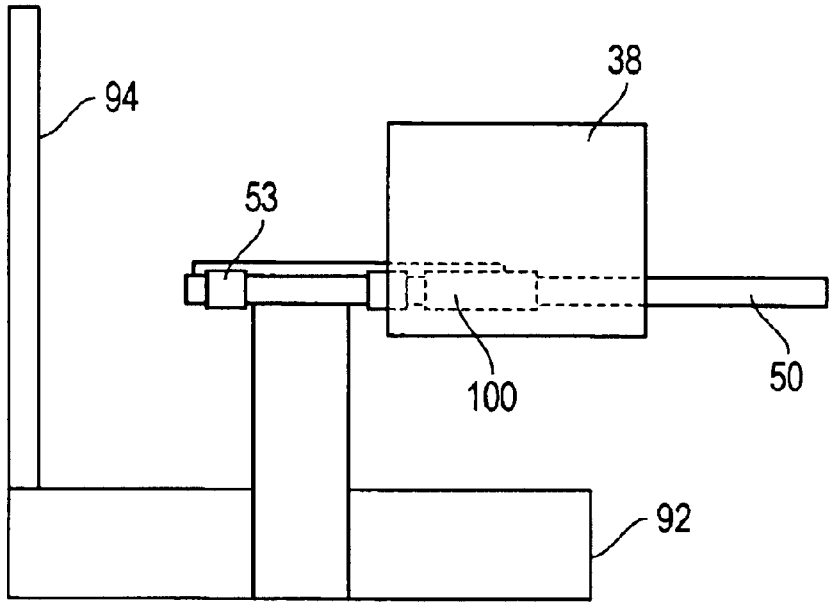
FIG. 9 is a partial side view of the right auxiliary platform of FIG. 8 in the stowed position.

FIG. 8 is a partial front view of the left and right side auxiliary platforms 36 and 38 in a stowed position. FIG. 9 is a partial side view of the right auxiliary platform 38 of FIG. 8 in the stowed position. Each auxiliary platform 36 and 38 may be mounted to their corresponding master support shaft. As illustrated in FIGS. 7 and 9, the right side auxiliary platform 38 is affixed to the right master support shaft 50 by the locking slide 52. In the extended position (FIGS. 6 and 7), the auxiliary platforms 36 and 38 are positioned in a generally horizontal orientation. The auxiliary platforms are held in position by tension screws (not shown). With the auxiliary platforms in the extended position, any devices positioned on the platforms are located next to each thigh of the operator seated in the chair 32. The side auxiliary platforms may be adjusted fore and aft along the master support shaft. When the auxiliary platforms are not needed, the auxiliary platforms may be placed in the stowed position (FIGS. 8 and 9). The side auxiliary platforms may be rotated to a generally vertical orientation. Additionally, the locking slide 52 may be slid rearwardly on the master support shaft 50 or 51. Thus, in the stowed position, the side auxiliary platforms may be position out of the way. The auxiliary platforms may also be positioned at intermediate angles between fully vertical and horizontal.

Referring back to FIG. 2, the system 30 may optionally include a secondary side accessory platform 42. The secondary side accessory platform may be affixed to the left master support shaft 51 in the same manner as the primary side accessory platform 40 is attached to the right master support shaft 50. The secondary side accessory platform may also include a rod 102, a collar 104 through which the master support shaft 51 extends through, and a set screw (not shown). The rod 102 may be laterally swivelled, thus allowing the secondary side accessory platform 42 to be laterally moved. The secondary side accessory platform may be utilized for positioning other control devices, drinks, or any other item which the operator wishes to have near. The secondary side accessory platform may be rigidly mounted to the support shaft or adjustably mounted for positioning in various orientations as desired by the operator (through the use of the swivelable rod 102).

Figure 10:
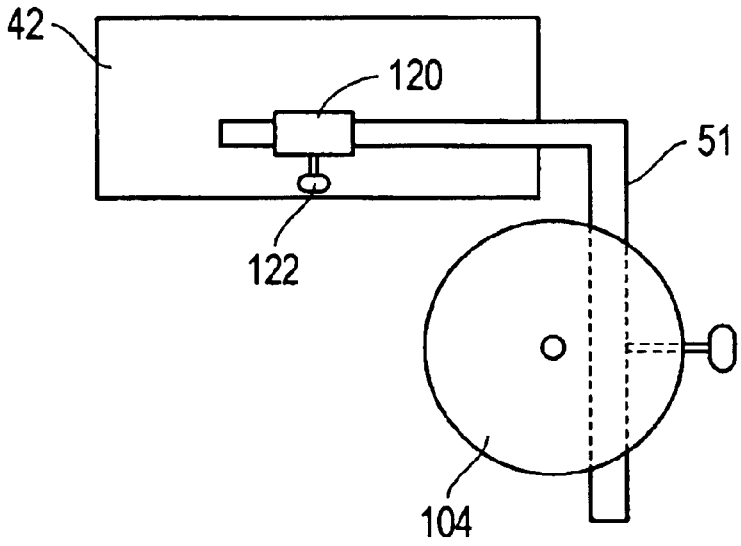
FIG. 10 is a front view of the secondary side accessory platform.

FIG. 10 is a front view of the secondary side accessory platform 42. The accessory platform 42 may be laterally rotated about the master support shaft 51 by rotating the collar 104 as illustrated. In addition, the set screw may be used to fix the collar in the desired position.

Figure 11:
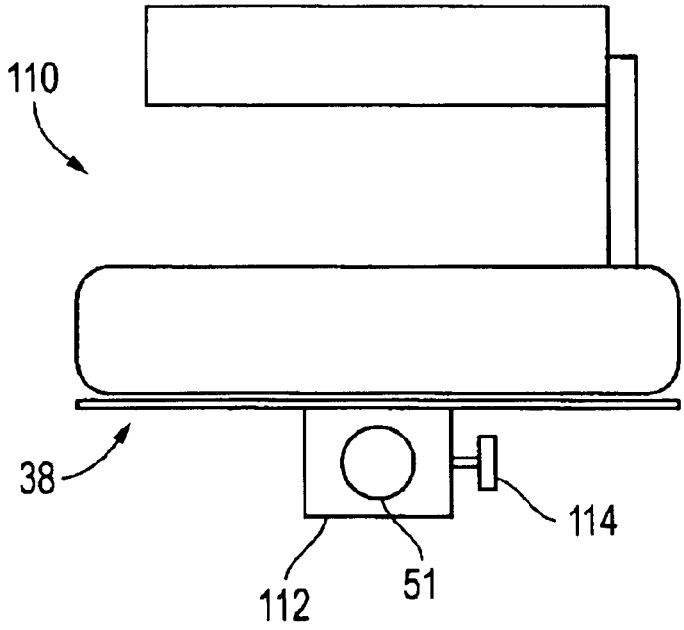
FIG. 11 is a front view of the left side auxiliary platform holding a computer input device.
Figure 12:
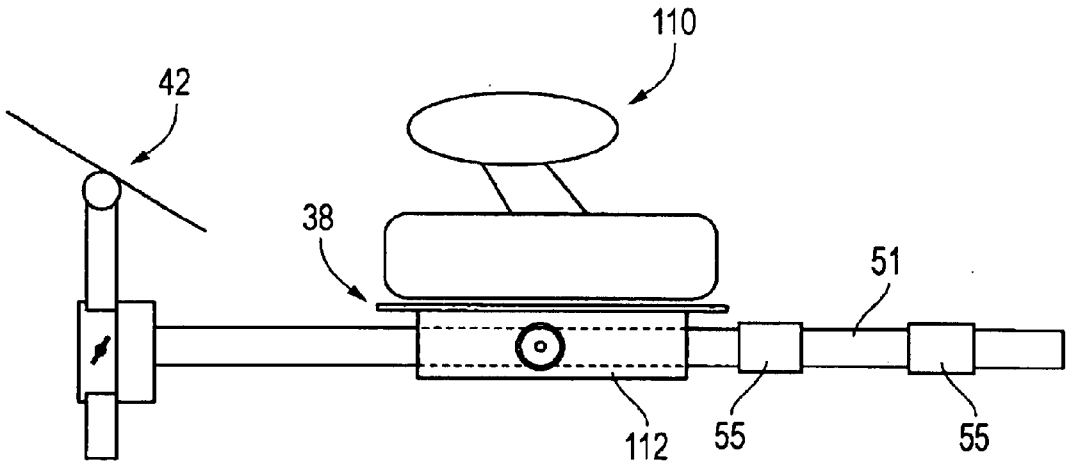
FIG. 12 is a left side view of the left side auxiliary platform of FIG. 11.

FIG. 11 is a front view of the left side auxiliary platform 36 holding a computer input device 110 (throttle). FIG. 12 is a left side view of the left side auxiliary platform 36 of FIG. 11. The left side auxiliary platform is affixed to the master support shaft 51 by a locking slide 112 having a tension screw 114. The locking slide allows forward and aft movement of the left side auxiliary platform along the length of the master support shaft. In addition, the locking slide may be laterally rotated about the shaft. When the desired position of the left side auxiliary platform is attained, the tension screw is tightened to secure the locking slide in the desired position to the shaft.

Figure 13:
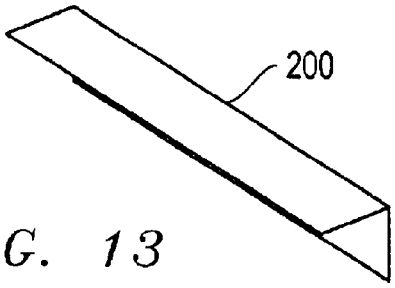
FIG. 13 is a front perspective view of a mounting device which may be used to affix the master support shafts to the chair.
Figure 14:
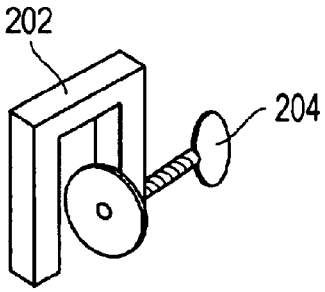
FIG. 14 is a front perspective view of a mounting bracket which may affix the master support shafts to the chair in an alternate embodiment of the present invention.

FIG. 13 is a front perspective view of a mounting device 200 which may be used to affix the master support shafts to the chair 32. FIG. 14 is a front perspective view of a mounting bracket 202 which may affix the master support shafts to the chair 32 in an alternate embodiment of the present invention. A locking mechanism may be used to adjustably lock the bracket to a portion of the chair. Either device may include bolts, adhesive material or any other connecting means for affixing the system 30 to the chair 32.

The system 30 may be mounted to most types of conventional chairs. In an alternate embodiment of the present invention, the system 30 is mounted to a wheel chair. The system 30 is particularly suitable for disabled individuals to operate control devices located near the individual. Additionally, the system may be affixed directly to the chair, thus removing the necessity of the master support shafts. Although the configuration illustrated is preferred, it should be understood by those skilled in the art of control input devices and office equipment, that additional platforms or the removal of one or more platforms may be utilized and still remain within the scope of the disclosed invention. The various control devices or other items placed on the plurality of platforms may or may not be affixed to the platforms. Preferably, hook and loop strips may be employed to allow detachment of the devices from the platforms. The system 30 may utilized a plurality of platforms on one or both sides of the chair.

The system 30 provides many benefits over existing devices. The system 30 provides a plurality of platforms for use by an operator on almost any existing chair. No modification is required to the chair to accommodate the system 30. Additionally, the system 30 allows the plurality of platforms to be mounted in several different positions and locations to accommodate any operator. For example, a left-handed person may desire for the right side auxiliary platform 38 be mounted on the left master support shaft 51. Additionally, a left-handed person may wish for the front platform to rotate about a pivot located on the left master support shaft 51. The plurality of platforms also provide rigid support for the control devices, while allowing adjustment of the platforms in multiple axes. The system 30 also reduces the required space necessary to operate the multiple control devices. Specifically, the system 30 does not require a table or desk to hold any of the control devices. The system 30 allows the plurality of platforms to be pivoted away from the operator's sitting area when not in use.

Additionally, the system 30 allows mobility of the operator and his control devices. The operator is no longer confined to the area of a desk holding all the control devices. The control devices utilized on the system 30 may be tethered to a computer or gaming system located in another location. The tether may be any length necessary by the operator to comfortable move about a room. In an alternate embodiment of the present invention, the control devices may be remotely operated without the requirement of a tether or cable (e.g., wireless connections). As stated above, the system 30 is particularly suited for disabled individuals bound to wheel chairs.

It is thus believed that the operation and construction of the present invention will be apparent from the foregoing description. While the system shown and described has been characterized as being preferred, it will be readily apparent that various changes and modifications could be made therein without departing from the scope of the invention as defined in the following claims.

What is claimed is:

1. A system for attaching a plurality of platforms to a chair, the system comprising:

a first support shaft affixed to a first side of the chair;

a second support shaft affixed to a second side of the chair;

a first platform attached to said first support shaft, said first platform includes a first coupling device for adjusting a horizontal and lateral position of said first platform in relation to the chair;

a second platform attached to said second support shaft, said second platform includes a second coupling device for adjusting a horizontal and lateral position of said second platform in relation to the chair; and a front platform positioned in front of the chair, said front platform rotatably affixed to said first support shaft, said front platform includes a third coupling device for adjusting a horizontal and lateral position of said front platform in relation to the chair;

whereby said first, second and front platforms may be adjustably positioned in a plurality of axes and capable of accommodating at least one control input device.

2. The system for attaching a plurality of platforms to a chair of claim 1 wherein said front platform rotates about a pivot point connecting said front platform to said first support shaft.

3. The system for attaching a plurality of platforms to a chair of claim 2 wherein said front platform is connected to a pivoting system allowing vertical rotation of said front platform away from a front portion of the chair.

4. The system for attaching a plurality of platforms to a chair of claim 3 wherein the pivoting system includes a tool balancer located opposite an arm extension affixed to said front platform, said tool balancer assisting in moving said front platform.

5. The system for attaching a plurality of platforms to a chair of claim 1 wherein:

said first platform is rotatably affixed to said first support shaft, said first platform being rotated away from the chair when not in use; and said second platform is rotatably affixed to said second support shaft, said second platform being rotated away from the chair when not in use.

6. The system for attaching a plurality of platforms to a chair of claim 1 further comprising a primary accessory platform affixed to said first support shaft, said primary accessory platform adjustably positioned laterally and horizontally on said first support shaft.

7. The system for attaching a plurality of platforms to a chair of claim 6 wherein said primary accessory platform includes a rod swivelably attached to said first support shaft and connected to said primary accessory platform, said rod allowing said primary accessory platform to rotate about a vertical axis.

8. The system for attaching a plurality of platforms to a chair of claim 6 further comprising a second accessory platform affixed to said second support shaft, said second accessory platform adjustably positioned laterally and horizontally on said second support shaft.

9. The system for attaching a plurality of platforms to a chair of claim 1 wherein said first and second support shafts are affixed to a first and second armrest of the chair.

10. The system for attaching a plurality of platforms to a chair of claim 1 wherein said first and second support shafts are detachably connected to the chair.

11. A system for positioning control devices on a chair, the system comprising:

a chair having a first side and an opposite second side;

a first support shaft affixed to the first side of the chair;

a second support shaft affixed to the second side of the chair;

a first platform attached to said first support shaft;

a second platform attached to said second support shaft; and a front platform positioned in front of the chair, said front platform rotatably affixed to said first support shaft, wherein said front platform is connected to a pivoting system allowing vertical rotation of said front platform away from a front portion of the chair, the pivoting system having a tool balancer located opposite an arm extension affixed to said front platform, said tool balancer reducing force required to pivot said front platform;

whereby said first, second and front platforms may be adjustably positioned in a plurality of axes and capable of accommodating at least one control input device.

12. The system for positioning control devices on a chair of claim 11 wherein said chair is a wheel chair.

13. The system for positioning control devices on a chair of claim 11 wherein:

said first platform includes a first coupling device for adjusting a horizontal and lateral position of said first platform in relation to the chair;

said second platform includes a second coupling device for adjusting a horizontal and lateral position of said second platform in relation to the chair; and said front platform includes a third coupling device for adjusting a horizontal and lateral position of said front platform in relation to the chair.

14. The system for positioning control devices on a chair of claim 11 wherein said front platform rotates about a pivot point connecting said front platform to said first support shaft.

15. A system for positioning control devices on a chair, the system comprising:

a chair having a first side and an opposite second side;

a first support shaft detachably affixed to the first side of the chair;

a first platform attached to said first support shaft, said first platform having a first coupling device for adjusting a horizontal and lateral position of said first platform in relation to the chair;

a front platform positioned in front of the chair, said front platform rotatably affixed to said first support shaft, said front platform having a third coupling device for adjusting a horizontal and lateral position of said front platform in relation to the chair and capable of being pivoted away from a front portion of the chair;

whereby said first and front platforms may be adjustably positioned in a plurality of axes and capable of accommodating at least one control input device.

16. The system for positioning control devices on a chair of claim 15 further comprising:

a second support shaft detachably affixed to the second side of the chair; and a second platform attached to said second support shaft, said second platform having a second coupling device for adjusting a horizontal and lateral position of said second platform in relation to the chair;

whereby said second platform may be adjustably positioned in a plurality of axes and capable of accommodating a second control input device.

17. The system for positioning control devices on a chair of claim 16 further comprising:

a primary accessory platform affixed to said first support shaft, said primary accessory platform adjustably positioned laterally and horizontally on said first support shaft.

* * * * *